United States Patent. [19]

Loerch

[11] Patent Number: 4,662,849

[45] Date of Patent: May 5, 1987

[54] OAR LOCK

[76] Inventor: Mark P. Loerch, 161 E. Lake Blvd., Winona, Minn. 55987

[21] Appl. No.: 801,570

[22] Filed: Nov. 25, 1985

[51] Int. Cl.[4] ..... B63H 16/073

[52] U.S. Cl. ..... 440/107; 440/106

[58] Field of Search ..... 440/106, 107, 108, 104, 440/105, 109, 110

[56] References Cited

U.S. PATENT DOCUMENTS 271,021 1/1883 Beaudreau ..... 440/107

2,315,155 3/1943 Glissendorf ..... 440/107

FOREIGN PATENT DOCUMENTS 529646 11/1940 United Kingdom ..... 440/107

*Primary Examiner*—Joseph F. Peters, Jr.

*Assistant Examiner*—Paul E. Salmon

[57] ABSTRACT

Two sleeves are arranged tangentially and are structurally connected to form the main body of the oar lock. One of the two sleeves, being larger than the other, is dimensioned to allow an oar shaft to pass through the sleeve. This larger sleeve is situated between two collars. The collars, which are secured to the oar shaft on each side of the larger sleeve, prevent the sleeve from sliding along the oar shaft. The smaller sleeve, being externally tangent to the larger sleeve, forms an oar lock body protrusion. Two members, that connect the collars, strike the oar lock body protrusion and serve to limit the oar shaft feathering rotation. The collars provide circumferential oar lock bearing against axial oar shaft loads. The sliding surface between the oar lock and the oar shaft is totally enclosed. The smaller sleeve is captively held to the stub shaft of a rotatable pivot elbow, of which the second stub shaft can be captively held in vertically oriented oar lock receptacles of boats, canoes, and of like watercraft. The oar may simultaneously pivot about both legs of the elbow.

1 Claim, 4 Drawing Figures

OAR LOCK

BACKGROUND

This invention relates to oar locks that provide for pivoting of an oar shaft about axes offset from the oar shaft centerline and to sculling oar locks with a restraining means consisting of straps or bars that extend across an oar lock to limit the feathering rotation of an oar.

The following patents define mechanisms that are germane to the patentability of the disclosed invention:

| | |
|---|---|
| 211,899 | J. Finn |
| 230,690 | E. A. Bennett |
| 416,239 | G. W. Roes |
| 555,747 | O. O. Storle |
| 2,315,155 | R. J. Glissendorf |

R. J. Glissendorf and J. Finn illustrate oar locks employing horizontally and vertically offset pivots, with the horizontal pivot mounted on the watercraft.

E. A. Bennett teaches the use of an oar lock employing only a horizontally offset pivot. The horizontal pivot axis of a rotatable mounting head is offset from the axial centerline of the oar shaft. A sleeve, that is fixed to the oar shaft, is rotatably arranged in the head. Pins, projecting from this sleeve, alternatively strike pins, that emanate from the sides of the head. Since the sleeve is fixed to the oar shaft, the pins limit the extent, to which an oar can be turned during feathering.

The oar lock of G. W. Roes utilizes a strap fastened to the oar shaft. The strap passes through a slot in the oar lock. The strap may be moved between the ends of the slot, allowing limited feathering of the oar shaft. The pivot axes are not offset from the axial centerline of the oar shaft. The oar lock pivots in a vertically positioned socket that is fastened to the watercraft.

O. O. Storle introduces an oar lock with the pivot axes and the feathering axis all offset from the axis of the oar shaft. The vertical pivot is mounted to the watercraft.

In the present invention, the oar lock fits watercraft oar lock receptacles that have upwardly extending centerline axes. Furthermore, the oar lock of the present invention allows the oar to be feathered to achieve optimum blade angle during the stroke and the recovery. The bearing surface between the oar lock and the oar shaft is not exposed, preventing the entrance of abrasive materials. The oar lock provides a large bearing area to counteract axial forces that are exerted on the oar shaft during rowing.

SUMMARY

The oar lock of the present invention fits oar lock receptacles, of which the extending centerline axes are oriented in upward directions. A pivot elbow allows a sleeve to be connected to oar lock receptacles that have upwardly extending centerline axes. The pivot elbow allows horizontal and vertical pivoting.

The sleeve on the pivot elbow is tangentially oriented with respect to a larger sleeve and is a structural part thereof. The larger sleeve surrounds the oar shaft and provides a large surface for circumferential bearing against axial oar shaft loads.

Two collars, that are secured to the oar shaft on each side of the larger sleeve, capture the sleeve to the oar shaft. The collars form a structural part of a cage, that limits the extent of oar shaft feathering rotation. Axial oar shaft loads are transmitted through the collars.

The sliding surface between the oar lock and the oar shaft is unexposed to contamination. The cage is situated externally with respect to the larger sleeve of the oar shaft and does not interrupt the sliding surface.

These and other features of the disclosed invention will become apparent in the following specification when considered in light of the attached drawing.

DRAWINGS

Figure 1:
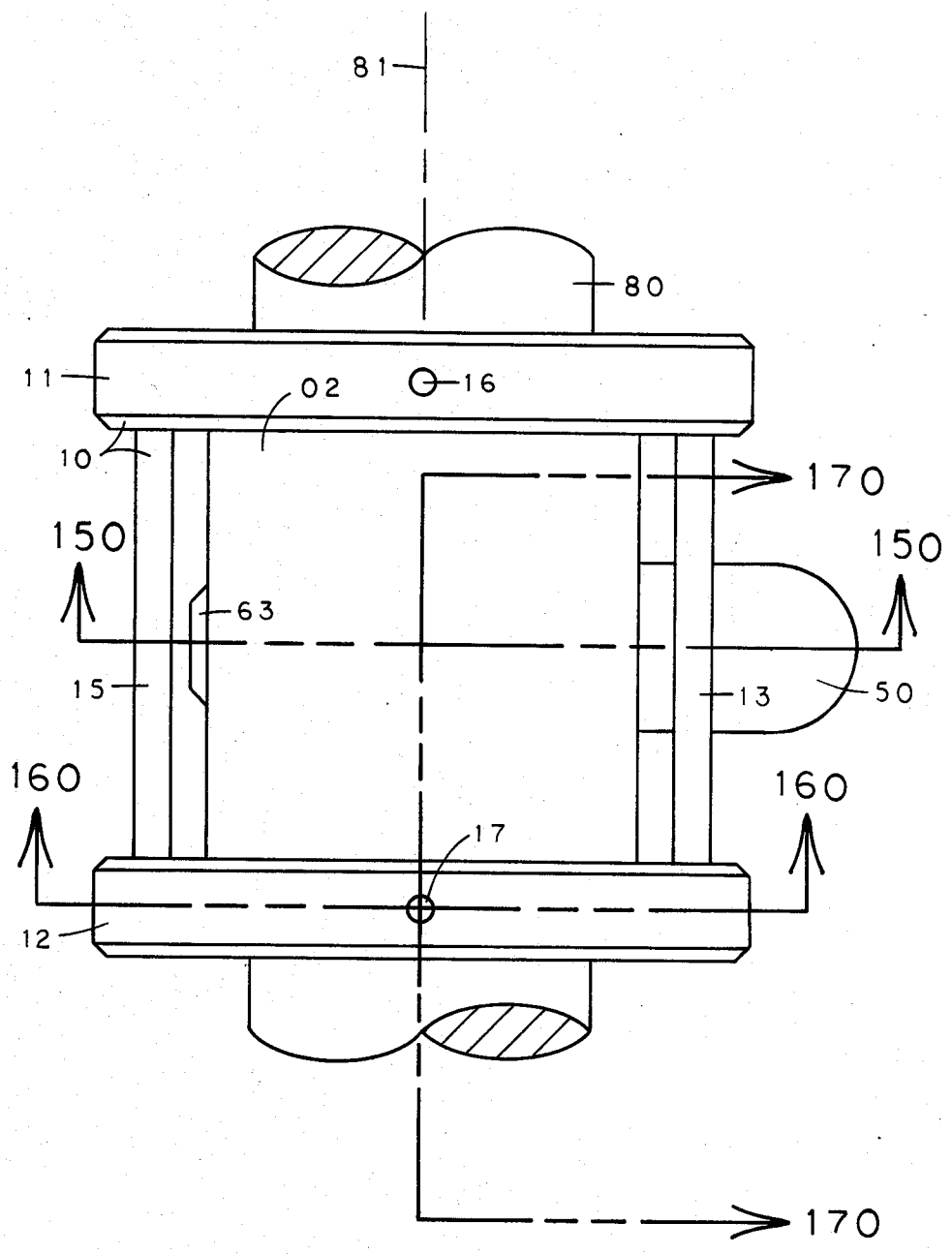
FIG. 1 is a top view of the oar lock.
Figure 2:
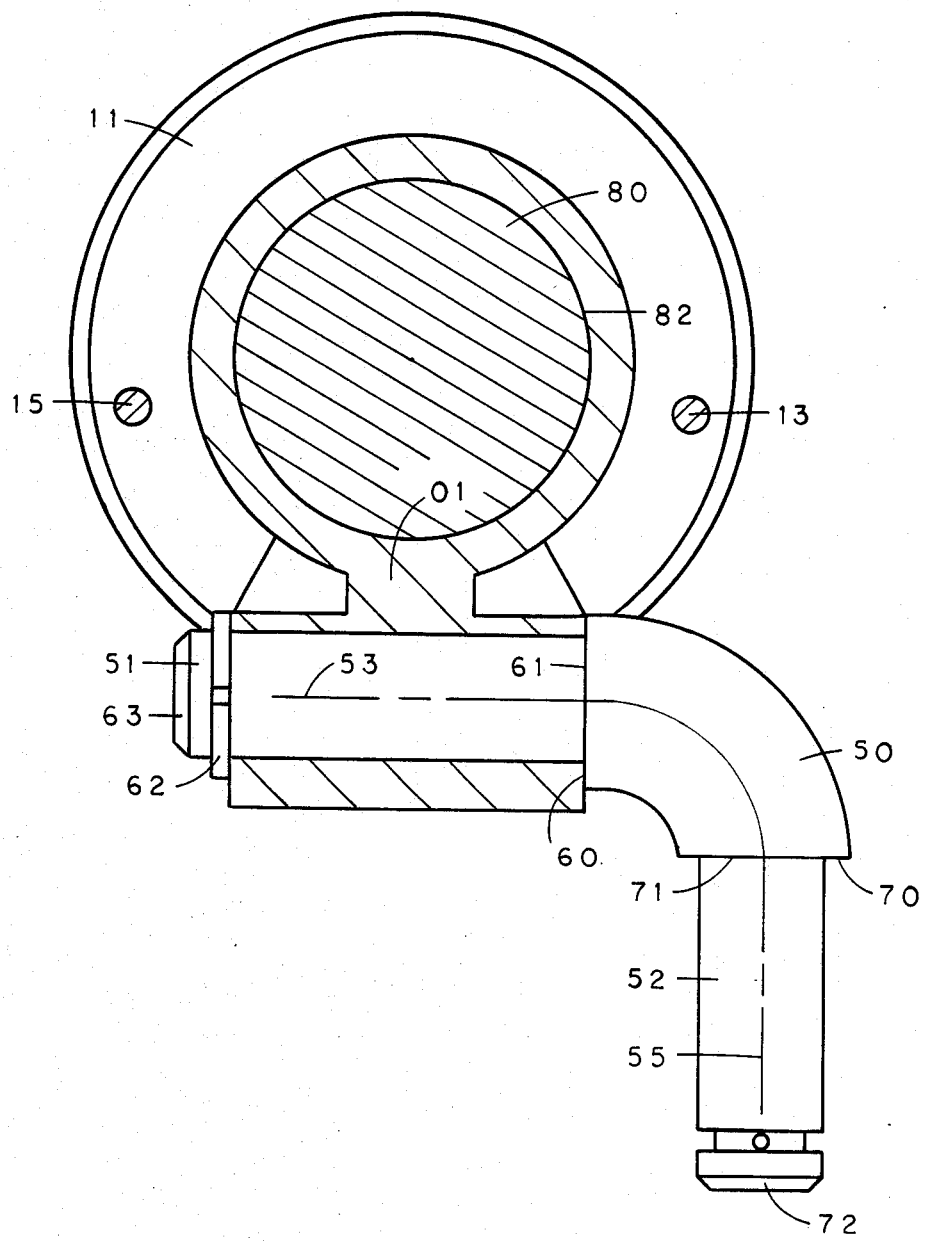
FIG. 2 is an end view of FIG. 1. The oar lock body is sectioned at line 150, 150 of FIG. 1.
Figure 3:
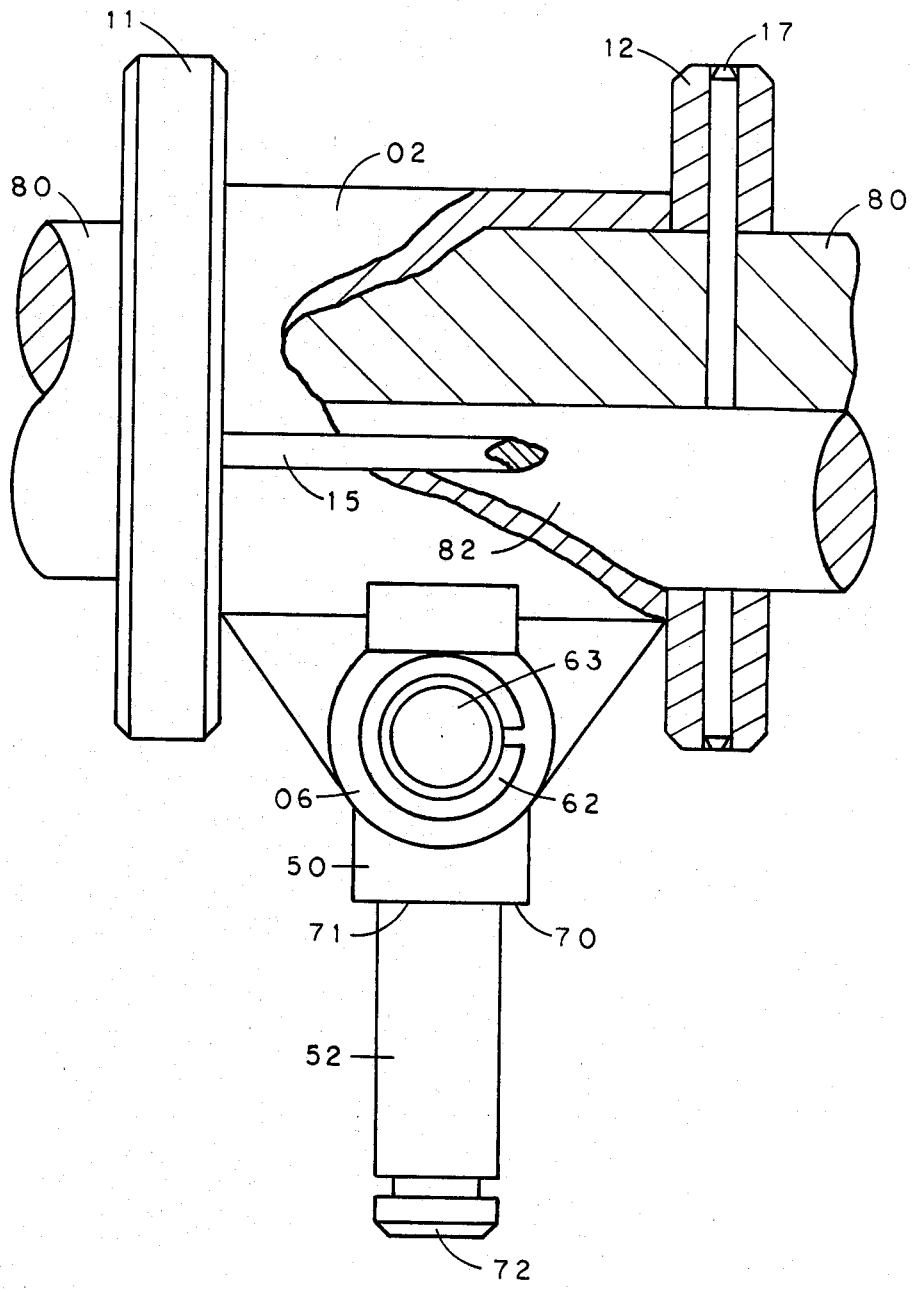

FIG. 3 is a side view of FIG. 1. The large sleeve of the oar lock body is partially broke away to expose a sectional view of the oar shaft and collar. The oar shaft and collar are sectioned at line 170, 170 of FIG. 1. Illustrated is the manner, in which the collar is secured to the oar shaft.

Figure 4:
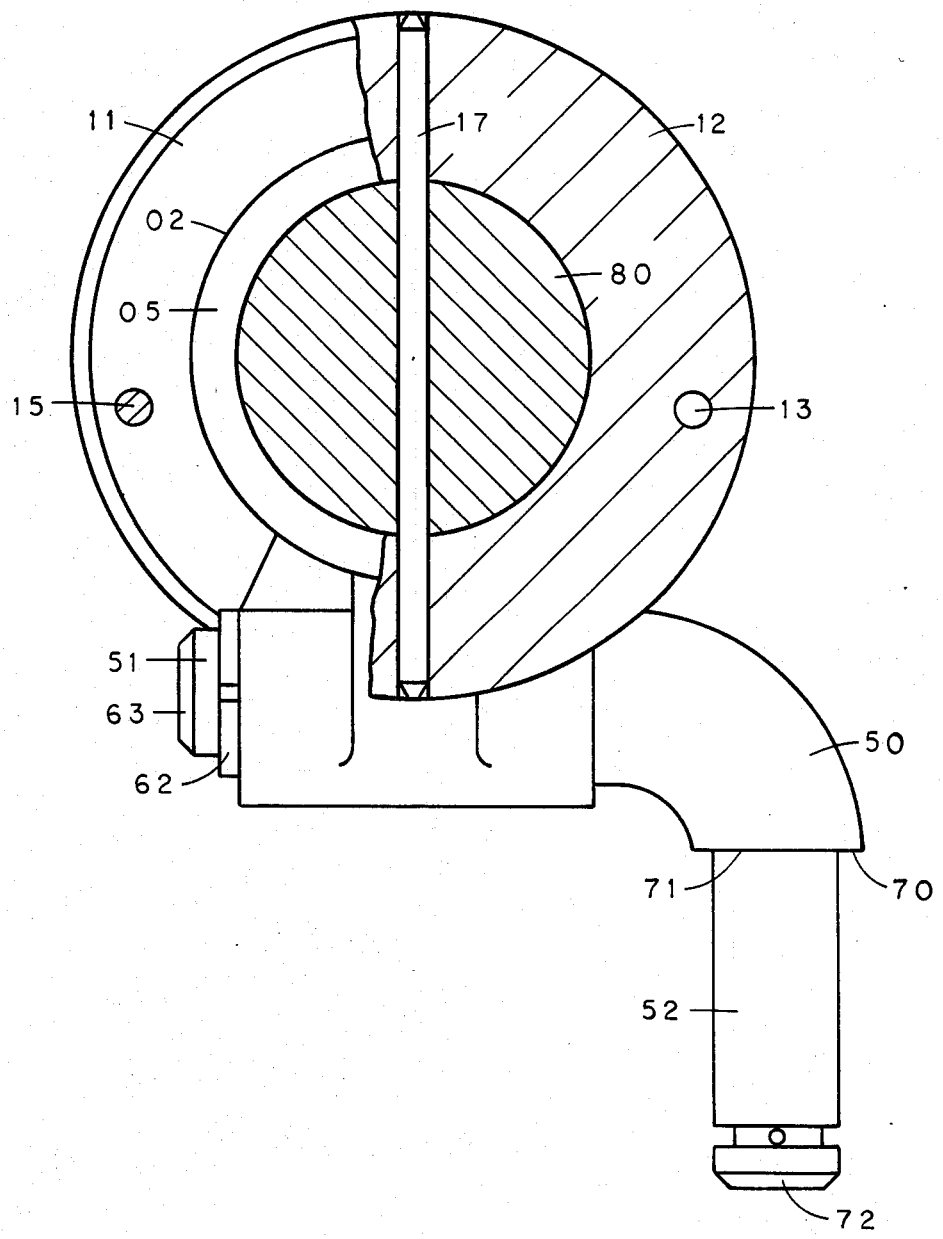

FIG. 4 is an end view of FIG. 1. The collar in the foreground is sectioned at line 160, 160 of FIG. 1. The collar in the foreground is also partially broken away to expose the bearing area of the large sleeve of the oar lock body.

DESCRIPTION

Two sleeves 02, 06 are arranged tangentially and are structurally connected to form an oar lock body 01. One of the two sleeves 02, being larger than the other 06, is dimensioned to allow an oar shaft 80 to pass through the sleeve 02. This larger sleeve 02 is situated between two collars 11, 12. The collars 11, 12 which are secured to the oar shaft 80 on each side of the larger sleeve 16, 17, capture the sleeve 02 to the oar shaft 80. The collars 11, 12 are a structural part of a cage 10, in which the body of the oar lock 01 is confined. The collars 11, 12, are affixed to the shaft of an oar 80 that is capable of feathering rotation. The cage 10, being integral to the shaft of the oar 80, is therefore rotatable.

The present example of oar lock construction includes two members 13, 15 that are elevated above the oar lock body 01. The two members 13, 15 connect the collars 11, 12 and form a structural part of the rotatable cage 10. The distance, by which the collars 11, 12 are separated, is spanned by the two members 13, 15. The small sleeve 06, being externally tangent to the large sleeve 02, forms an oar lock body protrusion. The protrusion extends outwardly across the circular paths of movement that are followed by the two connecting cage members 13, 15 during the feathering and unfeathering of the oar.

In addition to comprising a body 01 and a rotatable cage 10, the oar lock also includes a pivot elbow 50. The pivot elbow 50 has two structurally connected stub shafts 51, 52 of which the centerlines 53, 55 are oriented such that unit vectors along the centerlines 53, 55 form a vector dot product having an absolute value that is less than the cosine of 45 degrees. One stub shaft 51 passes through the small sleeve 06 of the oar lock body 01 and is offset from the oar shaft centerline 81. Unit vectors along the stub shaft centerline 53 and the oar shaft centerline 81 form a vector dot product having an absolute value that is less than the cosine of 45 degrees. The stub shaft 51 is captured to the body 01 by a shoulder 60 at the shaft base 61 and by a retainer 62 at the shaft tip 63. The second stub shaft 52 is to be inserted in an oar lock receptacle of a watercraft. A shoulder 70 at the shaft base 71 locates the stub shaft 52 in the receptacle. The stub shaft 52 may also be captured in the oar lock receptable by a retainer at the shaft tip 72, provided that the shaft 52 is longer than the receptacle.

OPERATION

The general functions and operation of the oar lock body 01 and the comprising parts thereof include the following: 1. the pivoting of an oar shaft 80 about axes that are offset from the oar shaft centerline 81 2. the rotating of the oar shaft 80 about its longitudinal centerline axis 81 prior to the recovery phase of an oar stroke such that the oar blade surface is positioned to skim across a water surface (hereafter referred to as feathering) 3. the rotating of the oar shaft 80 about its longitudinal centerline axis 81 prior to the catch phase of an oar stroke such that the oar blade surface is positioned normal to the water surface (hereafter referred to as unfeathering) 4. the limiting of oar shaft cage rotation.

The large sleeve 02 of the oar lock body 01 allows the oar shaft 80 to be feathered in one direction upon recovery of the oar from the water and to be unfeathered in the opposite direction at the beginning of a stroke before the catch. The large sleeve 02 provides a large bearing area 05 to counteract radial oar shaft forces that are exerted during rowing.

The small sleeve 06 of the oar lock body 01 is fitted to a stub shaft 51 of the pivot elbow 50 and allows the oar to be rotated about the stub shaft centerline 53.

The outward protrusion of the oar lock body 01 limits the rotation of the oar shaft 80 and the connecting cage members 13, 15 during the feathering and unfeathering of the oar.

The general functions and operation of the rotatable cage 10 and the comprising parts thereof include the following: 1. the shielding of the oar shaft sliding surface 82 from abrasive contaminants. 2. the circumferential bearing against axial oar shaft loads 3. the transmitting of oar shaft torques to the oar lock body 01.

The cage 10, of which the connecting members 13, 15 are externally situated with respect to the oar lock body 01, captures the oar lock body 01 to the oar shaft 80. The encaging of the oar lock body 01 allows the enclosure of the oar shaft sliding surface 82 to extend longitudinally of the oar shaft 80 without interruption and shields the oar shaft sliding surface 82 from abrasive contaminants. The collars 13, 15 capture the oar lock body 01 to the oar shaft 80. An axial load that is exerted by the oarsman at the oar handle is transmitted to the oar lock body 01 through the collars 11, 12.

The collars 11, 12 transmit to one connecting cage member 15 a force that is caused by oar shaft unfeathering torque. The oar shaft unfeathering torque is exerted by the oarsman at the beginning of an oar stroke prior to the catch. The collars 11, 12 also transmit to the other connecting cage member 13 a second force that is caused by oar shaft feathering torque.

The oar shaft feathering torque is exerted by the oarsman at the end of an oar stroke prior to the recovery.

One connecting member 13 of the cage 10 limits the feathering of an oar in such manner as to allow the attainment of the optimum blade angle during the recovery. (As used in this description and in the appended claims, the words, 'optimum blade angle' appear with the phrases, 'during the recovery', 'during a recovery phase' and mean in these instances any angle, at which the blade surface is positioned to skim across a water surface.) The other connecting member 15 of the cage 10 limits the unfeathering of an oar in such manner as to allow the attainment of the optimum blade angle at the beginning of the stroke. (As used in this description and in the appended claims, the words, 'optimum blade angle' appear with the phrases, 'at the beginning of the stroke', 'during a catch phase' and mean in these instances any angle, at which the blade surface is positioned normal to the water surface). The connecting members of the cage 13, 15 strike the outward protrusion of the oar lock body 01. The connecting cage members 13, 15 transfer and distribute to the oar lock body 01 the force that is transmitted through the collars 11, 12.

The general function of the pivot elbow 50 and the comprising parts thereof is to provide for the pivoting of an oar shaft 80 about axes that are offset from the oar shaft centerline 81. The pivot elbow 50 connects the oar lock body 01 to watercraft oar lock receptacles that have upwardly extending centerline axes.

The stub shaft 51, that passes through the small sleeve 06 of the oar lock body 01 functions as a pivotal offset for raising the oar during the recovery and for lowering the oar during the catch.

The second stub shaft 52 functions as a pivotal offset for swinging the oar through the stroke and for subsequently returning the oar to the starting position near the beginning of the stroke.

The shoulder 60 at the base 61 of the first stub shaft 51 and a retainer 62 at the tip of this same shaft 63 serve to captively hold the oar lock body 01 to the pivot elbow 50. The shoulder 70 at the base 71 of the second stub shaft 52 locates the shaft 52 in an oar lock receptacle. A retainer may be fitted to the tip of the second stub shaft 72 so as to capture this shaft 52 to the oar lock receptacle.

While the above description contains many specificities, these should not be construed as limitations on the scope of the invention, but rather as an exemplification of one preferred embodiment thereof. Many variations are possible. Examples of these variations include the following: an oar lock body being comprised of any number of shapes, from which any number of outward protrusions, projections, or protuberances may emanate to arrest the rotatable movement of a cage; a rotatable cage having any number of connecting members, with which to transmit oar shaft forces to an oar lock body. Accordingly, the scope of the invention should be determined not by the embodiment illustrated, but by the appended claims and their legal equivalents.

FOOTNOTE

The vector dot product is defined as the product of the amplitudes, multiplied by the cosine of the included angle:

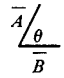

$\bar{A}\times\bar{B}$=Length (A)×Length (B)×cos $\theta$. If $\bar{A}$ & $\bar{B}$ are unit vectors, Length (A)=1, Length (B)=1, then $\bar{A}\times\bar{B}$ =cos $\theta$. In lines 12 through 21 on page 5 of the DESCRIPTION, $\bar{A}$ & $\bar{B}$ lie along centerlines; if $\bar{A}\times\bar{B}<\cos$ 45 degrees, the angle $\theta$ between the stub shafts 51, 52 must be greater than 45 degrees or less than 135 degrees.

The direction of the vectors along the centerlines, upon which angle ($\theta$ or 360 degrees$-\theta$) is selected, makes no difference, since the absolute value is stipulated. Since $\cos\theta=\cos$ (360 degrees$-\theta$), and $/\cos\theta/=/\cos$ (180 degrees$-\theta$)/, variations are equivalent. The dot product is a measure of perpendicularity between the axes of two vectors. For $\overline{A}\times\overline{B}=0$, $\overline{A}$ & $\overline{B}$ are perpendicular. If the centerlines of the stub shaft 51 and of the oar shaft 80 are substituted respectively for the stub shaft centerlines, along which $\overline{A}$ & $\overline{B}$ lie; the same relationship exists between the stub shaft 51 and the oar shaft 80.

What is claimed is:

1. A sculling oar lock having means by which said oar lock may be inserted and rotatably arranged in a watercraft oak lock receptacle that has an upwardly extending centerline axis, said oar lock providing for pivoting of an oar shaft about a second axis that is offset from the centerline of the oar shaft, said oar lock also providing for feathering and unfeathering of the oar shaft, said oar lock comprising:

(a) an oar lock body having a sleeve through which the oar shaft is rotatably arranged on a circumferential sliding surface of the oar shaft;

(b) a pivot elbow connected to said oar lock body;

(c) first and second stub shafts emanting from said pivot elbow with the axes of the stub shafts being oriented so that the angle between them is between 45° and 135°, said first stub shaft having a base, means at said base of said first stub shaft for shouldering said oar lock body on said first stub shaft, with said shouldering means capturing said oar lock body to said first stub shaft, said first stub shaft having a tip, a retainer at the tip of said first stub shaft that captures said oar lock body to said first stub shaft, said second stub shaft having a base, means at said base of said second stub shaft for shouldering the aforementioned watercraft oar lock receptacle on said second stub shaft, with said shouldering means of said second stub shaft locating said second stub shaft in said watercraft oar lock receptacle, said second stub shaft having a tip, means by which a retainer may be fitted to said tip of said second stub shaft to allow said second stub shaft upon passing through said watercraft oar lock receptacles to be captured thereto;

(d) oar lock body encaging means which shield the sliding surface of the oar shaft from abrassive contaminants and which transmit oar shaft loads to the oar lock body while allowing said oar feathering and unfeathering comprising two collars fixedly attached to the oar shaft, each of the collars attached to the oar shaft on either side of the oar lock body, enclosing the sliding surface of the oar shaft on both sides of the oar lock body, and a plurality of connecting members spaced radially outwards from the oar lock body and interconnecting the collars such that the collars and the connecting members encage the oar lock body and such that the oar lock body encaging means rotates as a structural part of said oar shaft upon said feathering and unfeathering of said oar shaft, said oar lock body having a plurality of outward protrusions, said connecting members of said oar lock body encaging means striking said plurality of outward protrusions upon rotating said oar shaft and said oar lock body encaging means for said feathering and unfeathering, such that the amount of said rotation is limited by said striking of the connecting members against the outward protrusions, whereby the oar lock body absorbs torques that are exerted on said oar shaft during said feathering and unfeathering of said oar shaft.

* * * * *